US008511634B2

(12) United States Patent
Lerchner

(10) Patent No.: US 8,511,634 B2
(45) Date of Patent: Aug. 20, 2013

(54) ANTENNA HOLDER

(75) Inventor: Henry Lerchner, Hannover (DE)

(73) Assignee: Blaupunkt Antenna System GmbH & Co. KG, Hildesheim (DE)

( * ) Notice: Subject to any disclaimer, the term of this patent is extended or adjusted under 35 U.S.C. 154(b) by 150 days.

(21) Appl. No.: 12/224,075

(22) PCT Filed: Jan. 22, 2007

(86) PCT No.: PCT/EP2007/050603

§ 371 (c)(1),
(2), (4) Date: Oct. 5, 2010

(87) PCT Pub. No.: WO2007/098996

PCT Pub. Date: Sep. 7, 2007

(65) Prior Publication Data

US 2011/0017899 A1 Jan. 27, 2011

(30) Foreign Application Priority Data

Mar. 2, 2006 (DE) ..... 10 2006 009 660

(51) Int. Cl.
*H01Q 1/32* (2006.01)

(52) U.S. Cl.
USPC ..... 248/534; 343/878; 343/715

(58) Field of Classification Search
USPC ..... 248/534, 231.21, 231.31, 231.9, 248/231.91, 220.21, 220.22, 221.11, 222.11, 248/222.12, 226.11; 343/711, 713, 715, 343/878, 906; 403/252; 411/49, 57.1, 60.1, 411/55

See application file for complete search history.

(56) References Cited

U.S. PATENT DOCUMENTS

| | | | | |
|---|---|---|---|---|
| 6,714,171 | B2 * | 3/2004 | Haussler et al. | 343/888 |
| 2005/0024280 | A1 | 2/2005 | Takahashi | |
| 2005/0237248 | A1 | 10/2005 | Nakano et al. | |
| 2006/0038729 | A1 | 2/2006 | Ohno et al. | |
| 2006/0110214 | A1 | 5/2006 | Kozlovski | |

FOREIGN PATENT DOCUMENTS

| | | | |
|---|---|---|---|
| DE | 196 40 110 | | 4/1998 |
| DE | 102 10 628 | | 10/2003 |
| DE | 102 33 065 | | 2/2004 |
| DE | 20 2004 007160 | | 7/2004 |
| DE | 20 2004 007 160 | U1 | 8/2004 |
| EP | 1 703 584 | | 9/2006 |
| JP | 2005-51412 | | 2/2004 |
| JP | 2005-506732 | | 3/2005 |
| JP | 2006248486 | A * | 9/2006 |
| WO | WO 03/032436 | | 4/2003 |
| WO | WO 03/107477 | | 12/2003 |

* cited by examiner

*Primary Examiner* — Terrell McKinnon
*Assistant Examiner* — Ingrid M Weinhold
(74) *Attorney, Agent, or Firm* — Kenyon & Kenyon LLP

(57) ABSTRACT

An antenna holder to be mounted on a car body part of a motor vehicle having an opening, in particular a motor vehicle roof, having an antenna base and an anchoring device projecting beyond the antenna base, whose outer cross section is smaller than the opening cross section of the opening. The preassembled anchoring device includes an anchoring claw having a plurality of spreadable arms, a spreading element for spreading apart the arms and an actuating member for the approach of the spreading element to the antenna base while the spreading apart of the arms takes place.

24 Claims, 4 Drawing Sheets

ANTENNA HOLDER

FIELD OF THE INVENTION

The present invention relates to an antenna holder for mounting on a body component of a motor vehicle, that is provided with an opening, and an antenna having such a holder.

BACKGROUND INFORMATION

Roof antennas of motor vehicles are usually developed as rod antennas and have an antenna holder fastened to the roof of the motor vehicle, in which the rod antenna itself is applied in a fixed or detachable manner. Known antenna holders, such as the antenna holder of an antenna system described in German Patent Application No. DE 102 33 065, as a rule have a broadened base part situated on the inside of the motor vehicle between the inside and the underside of the roof and the roof lining, as well as an anchor connected in one piece with the base, and the anchoring part projecting beyond the base, whose outer cross section is smaller than the opening cross section of the opening, so that it is able to be put through the opening from the inside, during the assembly of the holder. The anchoring part usually has an outer thread, onto which a fastening nut or lock nut may be screwed from the outside after it has passed through the opening, in order to fix the base lying against the roof from the inside, and firmly to clamp the roof between the base and the nut.

In these known antenna holders, it is regarded as disadvantageous that they have to be delivered for assembly in the form of two separate parts, the base and the fastening nut or lock nut, which not only makes difficult the logistics and handling before assembly, but also prolongs the time required for the assembly.

SUMMARY OF THE INVENTION

By contrast, the antenna holder according to the present invention offers the advantage that the parts required for assembling the antenna holder are able to be preassembled to form one component, which makes the logistics and handling easier before assembly, and reduces the time required for the mounting itself. In addition, using the design approach according to the present invention, the overall height of the antenna holder within the motor vehicle may be kept very small.

The present invention is based on the idea that an antenna holder anchored by spreading out the arms of an anchoring claw on the car body part does not have to be fixed by a lock nut from the side opposite the antenna base of the car body part, so that the lock nut required for this purpose up to now may be omitted.

A particularly firm anchoring of the antenna holder on the car body part is achieved if the spreading element, according to one preferred embodiment of the present invention, bends the arms of the anchoring claw during its approach to the antenna base, so that their free ends project beyond the outer cross section of the remaining anchoring system, and they are able to engage with a surface of the car body part facing away from the antenna base, in order firmly to clamp the car body part between the broadened antenna base and the free ends of the arms that point in the direction of the antenna base. These free ends are impressed into the car body part, in this context, especially if they are made pointed, according to an additional preferred embodiment of the present invention, which not only contributes to an immovable seat of the antenna holder on the car body part, but also makes possible the use of the arms as ground contact elements for grounding the antenna holder, that is, for producing an electrically conductive connection of the antenna holder by the body of the vehicle to a receiving unit built into the vehicle.

In order to apply the forces necessary for bending over the arms of the anchoring claw during the approach of the spreading element, the actuating member is preferably a nut, which, in addition, holds together the components of the anchoring system in the preassembled state.

A further preferred embodiment of the present invention provides that the screw is put all the way through a passageway in the spreading element and in the anchoring claw and screwed into an internal thread in the antenna base, and that it lies against the spreading element with its broadened head part, in order to pull the spreading element in the direction of the antenna base, when the screw is tightened. The anchoring device is then pushed from one side, in the case of roof antennas from the outside of the vehicle, through the opening in the car body part, while the screw is pulled tight from the opposite side, in the case of roof antennas from the inside of the vehicle. In this case, the antenna holder is expediently provided with a fixing aid, using which it may be pre-fixed, after being put through the opening with respect to the car body part, so that the antenna holder does not move out of the opening again, as a result of an axial press-on force possibly applied to the screw during its tightening. The fixing aid is expediently made up of a preassembled metallic spring clip, whose leg is provided with latching projections, which engage behind the car body part after the anchoring device is pushed through the opening, but the anchoring device could alternatively also include attached elastic locking tongues made of plastic.

Alternatively to this, however, it would also be conceivable to put the screw through a passageway in the antenna base and through the anchoring claw into an internal screw thread of the spreading element, so that the anchoring device is first put through the opening from one side, and then the screw that has its head lying against the antenna base is able to be tightened from the same side, from the outside, in the case of a roof antenna. Since, in this case, the broadened antenna base is pressed against the car body part, because of the press-on force exercised on the screw in response to its tightening, one could do without the fixing aid.

A further preferred embodiment of the present invention provides that the spreading element has a plurality of spreading arms complementary to the arms of the anchoring claw which, when the screw is tightened, are guided the same as the arms of the anchoring claw in guideways of the anchoring device and preferably in guideways of a socket part of the anchoring device that is rigidly connected to the antenna base.

The spreading arms preferably have on their sides, that are adjacent to the arms of the anchoring claw, bent sliding surfaces diverging away from the antenna base, on which the arms of the anchoring claw move along when the bending takes place, in order to give them the desired shape when they are deformed. In order to facilitate the bending and spreading out of the anchoring claw, these arms may additionally have a cross sectional reduction, which is expediently situated at or near their base.

DETAILED DESCRIPTION

Figure 1:
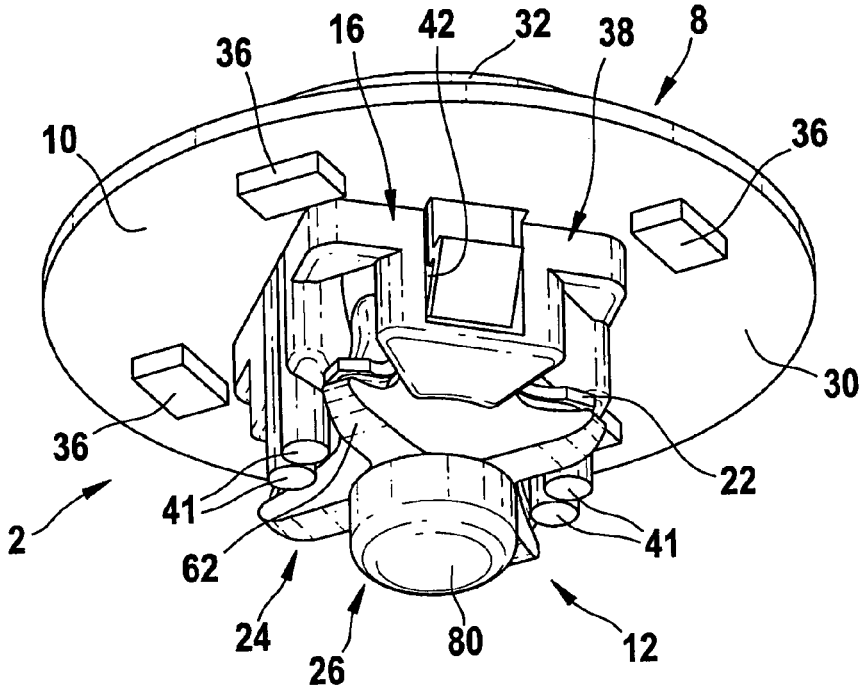
FIG. 1 shows an underside view in perspective of the preassembled antenna holder, before being mounted on the roof of a motor vehicle.

Antenna holder 2 shown in the drawings is used for mounting a roof antenna (not shown) on a roof 4 (FIG. 2) of a motor vehicle, which is provided with an opening 6 that is square in outline, at the location provided for mounting the antenna.

Figure 2:
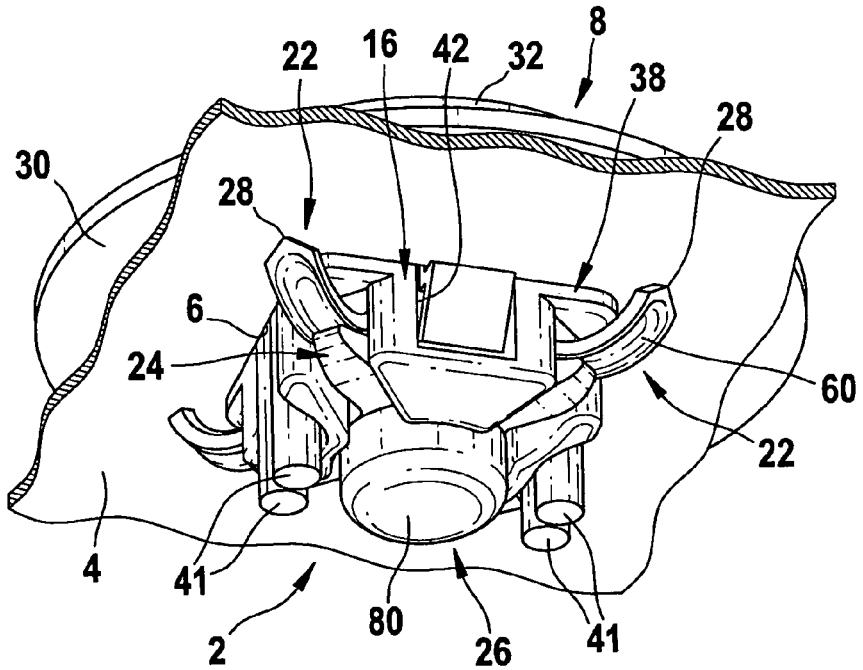
FIG. 2 shows an underside view in perspective of the antenna holder, after being mounted on the roof of a motor vehicle.
Figure 3:
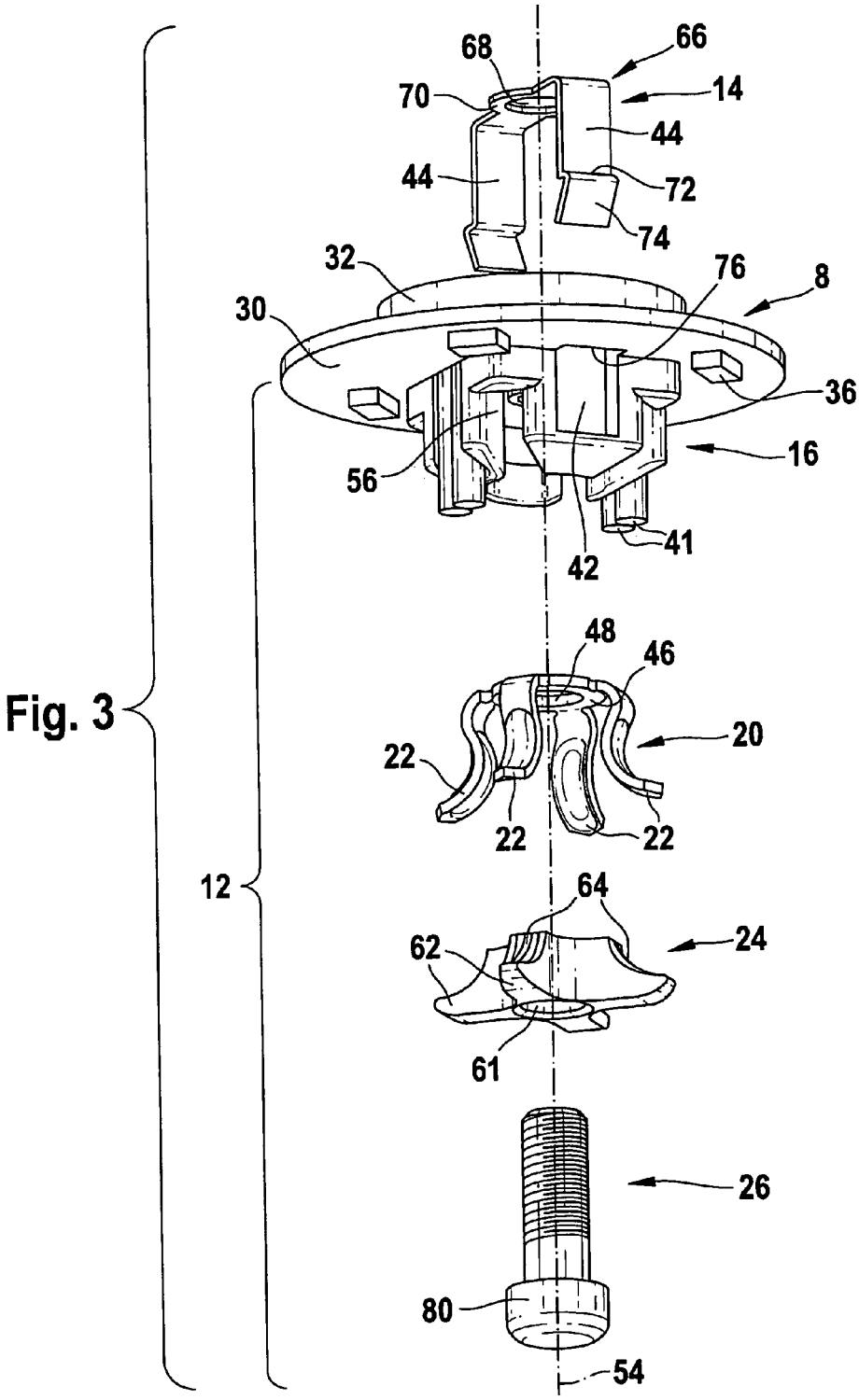
FIG. 3 shows an exploded perspective view of all the components of the antenna holder.

As is shown best in FIGS. 1 through 3, antenna holder 2 includes a broadened antenna base 8 provided for mounting outside the passenger compartment of the motor vehicle, a preassembled anchoring device 12 extending beyond an underside 10 of antenna base 8, whose cross sectional dimensions are smaller than the cross sectional dimensions of opening 6, so that it is able to be pushed through opening 6 from the outside of roof 4 during the mounting of antenna holder 2, as well as a fixing aid 14 (FIG. 3), with the aid of which antenna holder 2 is able to be preliminarily fixed within opening 6 after the passing of anchoring device 12 through opening 6.

As is shown best in FIG. 3, preassembled anchoring device 12 includes a socket part 16 that protrudes beyond the underside of antenna base 8 and is connected as one piece with antenna'base 8, an anchoring claw 20 that is set from below into a recess 18 (FIG. 4) of socket part 16, anchoring claw 20 having four bent arms 22, a spreading element 24 situated below anchoring claw 20, as well as a screw 26, which holds together components 16, 20, 24 of preassembled anchoring device 12, and is used to make spreading element 24 approach antenna base 8, after the introduction of anchoring device 12 into opening 6 for anchoring antenna holder 2, so as thereby to spread out and bend over arms 22 of anchoring claw 20, until their free ends 28 engage with the inner side of roof 4, and base part 8 is drawn against the outer side of roof 4, as shown in FIG. 2.

As is shown best in FIGS. 1 and 3, antenna base 8 is made essentially of a flat circular base plate 30 and a reinforcing part 32, applied to the upper side of base plate 30, which forms a part of a holder for fixing aid 14, and has a threaded bore 34 (FIG. 4) for screw 26 that is extended all the way through base plate 30. On its underside, base plate 30 is provided with a plurality of foam paddings 36, which are intended to prevent the scratching of the paint on the outer side of roof 4 around opening 6, during the mounting of antenna holder 2.

Figure 4:
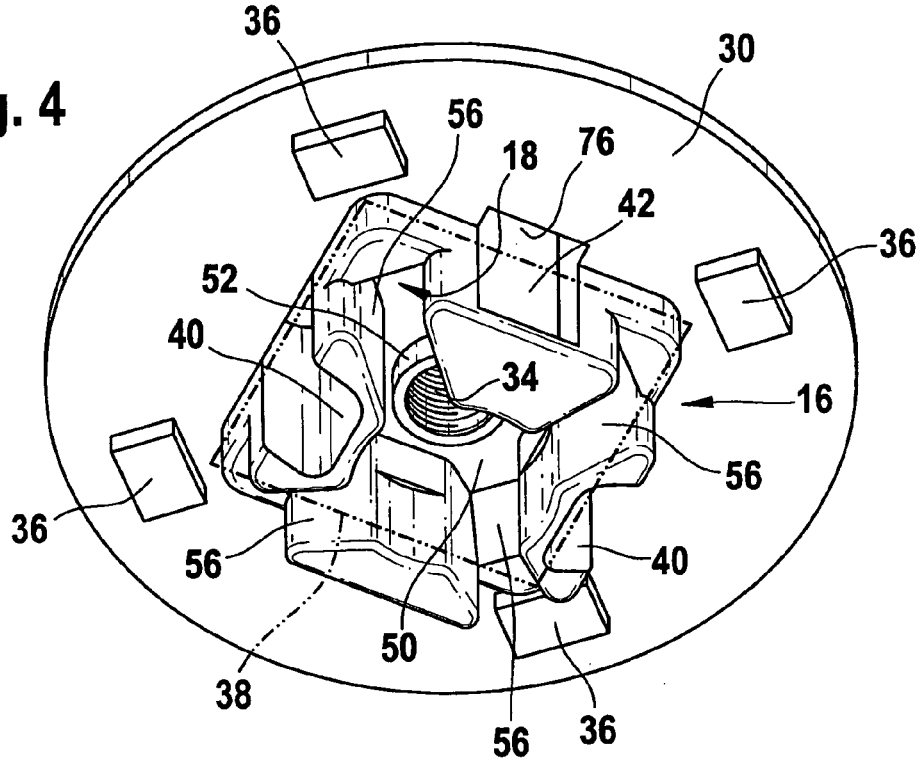
FIG. 4 shows an enlarged perspective underside view of an integral base part and anchoring part of the antenna holder.

As is shown best in FIGS. 1, 2 and 4, socket part 16 of anchoring device 12, that is connected as one piece with antenna base 8, and is produced together with it by injection molding, has a square outer cross section 38 adapted to the opening cross section of opening 6, bordering on base plate 30, so that socket part 16 fits into opening 6, and is assured in it against being rotated. Moreover, socket part 16 has two cut-outs 40 (FIG. 4) that are open edged towards the outside and situated at opposite outer sides, which in each case, together with an opposite edge section of opening 6, limit a passage for in each case two antenna cables 41 of the antenna, shown in FIGS. 1 and 2. At the two other outer sides, socket part 16 is also provided with two cut-outs 42 that open outwards, into which, in each case, there extend one of two springily bendable legs 44 of fixing aid 14. In the middle, socket part 16 is provided with recess 18 that is open downwards, away from base plate 30, in which anchoring claw 20 is inserted in such a way that it is supported by a planar annular center part 46, having an outer square, against a complementary end face 50 of recess 18. Circular opening 48 of center part 46 of anchoring claw 20, in this context, lies with its inner circumferential edge, from the outside, against a cylindrical collar 52 that extends beyond the end face of recess 18, the collar surrounding the opening out of threaded bore 34 into cut-out 18, in order to center anchoring claw 20 with respect to axis of rotation 54 of screw 26. For the accommodation of the four arms 22 of anchoring claw 20, socket part 16 is provided with four radial slot openings 56, which extend in the direction of the diagonals of square outer cross section 38 of socket part 16, and are open inwards towards cut-out 18, outwards as well as away from base plate 30 in the downward direction.

Figure 6:
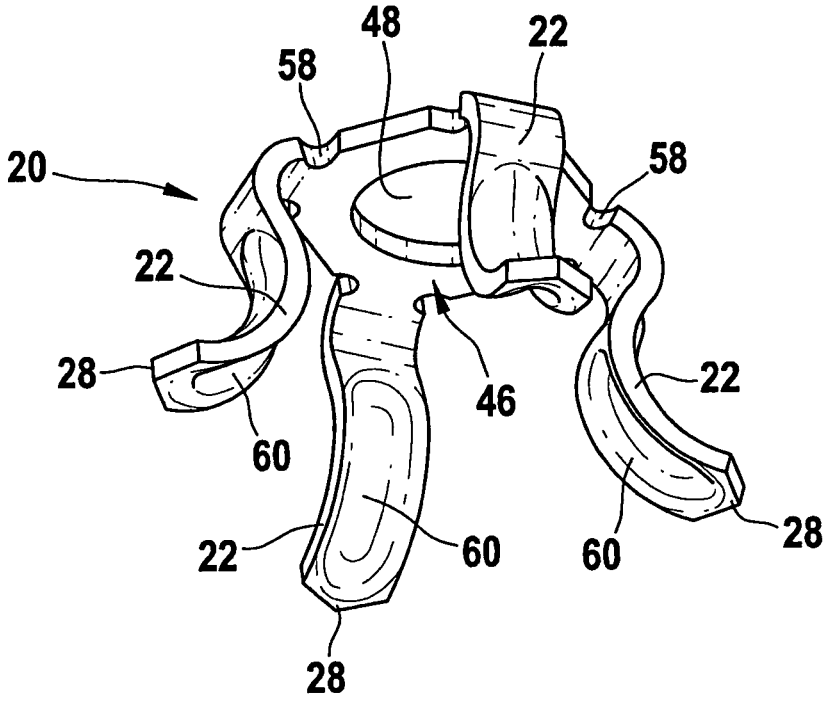
FIG. 6 shows an enlarged perspective underside view of a fastening claw of the antenna holder.

As is shown best in FIG. 6, the four arms 22 of anchoring claw 20, which project slantwise downwards and outwards over center part 46 and are connected as one piece to center part 46, are in their undeformed initial state bent gently into an S-shape. The arms 22 have an essentially constant width, but at their base, at the transition to center part 46, they are provided with a narrowing in their cross section, in the form of two opposite, lateral notches 58, which make it easier to bend over arms 22 with respect to center part 46. The length and the shape of arms 22 are selected so that, after preassembly of anchoring device 12, they are situated inside slot openings 56 of socket part 16, their free ends 28 not extending beyond square outer cross section 38 of socket part 16. Bordering on their free ends 28, arms 22 are provided over a part of their length with an embossing 60, so that they have a concavely curved inner side and a convexly curved outer side in that area. Free ends 28 of arms 22 are made pointed, so that they press from below into the inner side of roof 4 of the motor vehicle, when they are pressed against roof 4 after the anchoring of antenna holder 2 in the position shown in FIG. 2, where they are spread apart and deformed and directed towards base plate 30.

Figure 5:
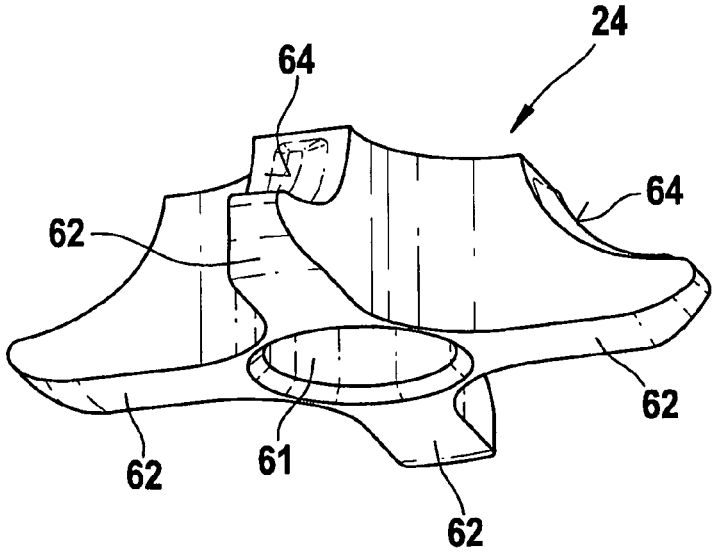
FIG. 5 shows an enlarged perspective underside view of a spreading element of the antenna holder.

As is shown best in FIG. 5, spreading element 24 has an axial passageway 61 for screw 26 and four spreading arms 62 situated around passageway 61 at an angular distance of 90 degrees each, which are provided with sliding surfaces 64 that are bent and convex in cross section on their upper side facing base plate 30, which are essentially developed to be complementary to the concave inner sides of adjacent arms 22 of anchoring claw 20. After introducing anchoring device 12 into opening 6, when spreading element 24 is brought closer to base plate 30 by screwing screw 26 into threaded bore 34, spreading element 24 being guided in slot openings 56 of socket part 16, same as arms 22 of anchoring claw 20, spreading arms 62 impose a force that is in each case directed upwards and outwards along bent sliding surfaces 64 on the adjacent arm 22 of anchoring claw 20. Because of this force, arms 22 are spread out and bent over while being deformed, their free ends 28 moving out in the radial direction of axis of rotation 54 of screw 26, increasingly further out of slot openings 56 of socket part 16, and are finally pressed against the inside of roof 4 using their pointed free ends 28, as is shown in FIG. 2.

As is shown best in FIG. 3, fixing aid 14 is essentially a U-shaped piece of sheet metal 66, having yoke 70 provided with a through hole 68 for screw 26, and the two springily elastic legs 44 which, in the vicinity of their free ends are bent outwards, forming a latching projection 72 and then are bent downwards at a slant to form a run-up ramp 74. For preassembly, fixing aid 14 is placed from above onto base part 8 of antenna holder 2, as shown in FIG. 3, the ends of leg 44 being introduced through slots 76 in base plate 30 into the two opposite recesses 42 of socket part 16, as is shown best in FIG. 1, until yoke 70 touches the upper side of reinforcement part 32.

During the mounting of antenna holder 2, when anchoring device 12 is introduced from above and from outside into opening 6 in roof 4 of the motor vehicle, the free ends of legs 44 are pressed together a little as a result of the contact of run-up ramp 44 with the edge of opening 6, until latching projections 72 latch under the roof, as shown in FIG. 2, and thus "pre-fix" the antenna holder in opening 6 in such a way that, upon subsequent tightening of screw 26, it is neither able to turn nor give way in the axial direction of the axis of rotation 54 of the screw.

During the tightening of screw 26, it is screwed into threaded bore 34 of base plate 30 and reinforcement part 32, from the direction of the passenger compartment, spreading element 24 moving upwards in the direction of base plate 30, using a head 80 that is provided with multiple sides, inside or outside, (that is not shown). In the process, arms 22 of anchoring claw 20 are bent by the force exercised on them by spreading arms 62, and are spread outwards until roof 4 is firmly clamped between ends 28 of arms 22 and base plate 30, and antenna holder 2 is thereby anchored on roof 4 in immovable fashion.

What is claimed is:

1. An antenna holder to be mounted on a body part of a motor vehicle having an opening, comprising:

an antenna base; and a preassembled anchoring device projecting beyond the antenna base, the outer cross section of the preassembled anchoring device being smaller than an opening cross section of the opening of the motor vehicle;

wherein the preassembled anchoring device includes:

a socket part which is connected with the antenna base, an anchoring claw having a plurality of spreadable arms, a spreading element, and an actuating member with at least one of an axis of rotation and a central axis, wherein the spreadable arms of the anchoring claw, in a non-deformed initial state, are arranged running from a center part of the anchoring claw obliquely away from the antenna base and outwards from the axis of the actuating member, wherein the spreading element is arranged on a side of the anchoring claw lying facing away from the antenna base, wherein the spreading element has spreading arms that act on the spreadable arms of the anchoring claw so that on actuation of the actuating member, the spreadable arms of the anchoring claw are spread apart as the spreading element approaches the antenna base, the spreading element bending the spreadable arms of the anchoring claw while effecting a deformation and directing the spreadable arms towards the antenna base so that free ends of the spreadable arms in a spread-apart position press onto a surface of the body part facing away from the antenna base, as the spreadable arms are bent upwardly towards the antenna base by the spreading element, and wherein the spreadable arms of the anchoring claw have embossings extending over part of the length of the arms, with a convexly curved outer side facing the antenna base and with a concavely curved inner side pointing away from the antenna base, and wherein the spreading arms of the spreading element are provided on an upper side of the spreading arms, facing the antenna base, with sliding surfaces which are bent and are convex in cross-section, which are essentially configured to correspond generally in shape to the concave inner sides of the spreadable arms of the anchoring claw.

2. The antenna holder according to claim 1, wherein the body part is a motor vehicle roof.

3. The antenna holder according to claim 1, wherein the spreading element bends the arms of the anchoring claw while the spreading element is approaching the antenna base, so that the free ends project beyond the outer cross section of the preassembled anchoring device and become engaged with a surface of the car body part facing away from the antenna base.

4. The antenna holder according to claim 1, wherein the actuating member is a screw, which holds together components of the anchoring device in a preassembled state.

5. The antenna holder according to claim 4, wherein the screw penetrates passageways in the spreading element and in the anchoring claw.

6. The antenna holder according to claim 4, wherein the screw is in threaded engagement with the antenna base, and lies against the spreading element using a widened head part.

7. The antenna holder according to claim 1, wherein the spreading arms have bent sliding surfaces diverging from the antenna base for acting on the arms of the anchoring claw.

8. The antenna holder according to claim 1, wherein the free ends of the spreadable arms of the anchoring claw are pointed.

9. The antenna holder according to claim 1, wherein the arms of the anchoring claw have a cross sectional narrowing at or near their base.

10. The antenna holder according to claim 1, wherein a fixing aid pre-fixes the antenna holder in the opening.

11. The antenna holder according to claim 1, wherein the antenna holder is part of a roof antenna for a motor vehicle.

12. The antenna holder according to claim 1, wherein the actuating member is configured as a screw, constructed separately from the spreading element.

13. The antenna holder according to claim 12, wherein the actuating member is in the form of a screw and holds together the socket part connected with the antenna base, the anchoring claw and the spreading element of the anchoring device in the preassembled state.

14. The antenna holder according to claim 12, wherein the screw penetrates passageways in the spreading element and in the anchoring claw.

15. The antenna holder according to claim 12, wherein the screw is in threaded engagement with the antenna base and lies against the spreading element using a widened head part of the screw.

16. The antenna holder according to claim 1, wherein the spreadable arms of the anchoring claw in the non-deformed initial state of the spreadable arms are bent slightly in an S-shape.

17. An antenna system, comprising:

a roof antenna for a motor vehicle; and an antenna holder to be mounted on a body part of a motor vehicle having an opening, including:

an antenna base; and a preassembled anchoring device projecting beyond the antenna base, an outer cross-section of the antenna base being larger than an opening cross section of the opening of the motor vehicle, wherein the preassembled anchoring device includes:

a socket part which is connected with the antenna base, an anchoring claw having a plurality of spreadable arms, a spreading element, and an actuating member with at least one of a rotation axis and a central axis, wherein the spreadable arms of the anchoring claw, in a non-deformed initial state, are arranged running from a center part of the anchoring claw obliquely away from the antenna base and outwards from the axis of the actuating member, wherein the spreading element is arranged on a side of the anchoring claw lying facing away from the antenna base, and wherein the spreading element has spreading arms that act on the spreadable arms of the anchoring claw so that on actuation of the actuating member, the spreadable arms of the anchoring claw are spread apart as the spreading element approaches the antenna base, the spreading element bending the spreadable arms of the anchoring claw while effecting a deformation and directing the spreadable arms towards the antenna base so that free ends of the spreadable arms in a spread-apart position press onto a surface of the body part facing away from the antenna base, as the spreadable arms are bent upwardly towards the antenna base by the spreading element, and wherein as the spreadable arms are bent upwardly towards the antenna base by the spreading element, each of the spreading arms of the spreading element and each of the spreadable arms of the anchoring claw ride within guides.

18. The antenna system according to claim 17, wherein the guides are formed by slots in the socket part.

19. An antenna holder to be mounted on a body part of a motor vehicle having an opening, comprising:

an antenna base; and a preassembled anchoring device projecting beyond the antenna base, the outer cross section of the preassembled anchoring device being smaller than an opening cross section of the opening of the motor vehicle;

wherein the preassembled anchoring device includes:

a socket part which is connected with the antenna base, an anchoring claw having a plurality of spreadable arms, a spreading element, and an actuating member with at least one of an axis of rotation and a central axis, wherein the spreadable arms of the anchoring claw, in a non-deformed initial state, are arranged running from a center part of the anchoring claw obliquely away from the antenna base and outwards from the axis of the actuating member, wherein the spreading element is arranged on a side of the anchoring claw lying facing away from the base plate, wherein the spreading element has spreading arms that act on the spreadable arms of the anchoring claw so that on actuation of the actuating member, the spreadable arms of the anchoring claw are spread apart as the spreading element approaches the antenna base, the spreading element bending the spreadable arms of the anchoring claw while effecting a deformation and directing the spreadable arms towards the antenna base so that free ends of the spreadable arms in a spread-apart position press onto a surface of the body part facing away from the antenna base, and wherein as the spreadable arms are bent upwardly towards the antenna base by the spreading element, each of the spreading arms of the spreading element and each of the spreadable arms of the anchoring claw ride within guides.

20. The antenna holder according to claim 19, wherein the guides are formed by slots in the socket part.

21. An antenna holder to be mounted on a body part of a motor vehicle having an opening, comprising:

an antenna base; and a preassembled anchoring device projecting beyond the antenna base, the outer cross section of the preassembled anchoring device being smaller than an opening cross section of the opening of the motor vehicle;

wherein the preassembled anchoring device includes:

a socket part which is connected with the antenna base, an anchoring claw having a plurality of spreadable arms, a spreading element, and an actuating member with at least one of an axis of rotation and a central axis, wherein the spreadable arms of the anchoring claw, in a non-deformed initial state, are arranged running from a center part of the anchoring claw obliquely away from the antenna base and outwards from the axis of the actuating member, wherein the spreading element is arranged on a side of the anchoring claw lying facing away from the base plate, wherein the spreading element has spreading arms that act on the spreadable arms of the anchoring claw so that on actuation of the actuating member the spreadable arms of the anchoring claw are spread apart as the spreading element approaches the antenna base, the spreading element bending the spreadable arms of the anchoring claw while effecting a deformation and directing the spreadable arms towards the antenna base so that free ends of the spreadable arms in a spread-apart position press onto a surface of the body part facing away from the antenna base, and wherein as the spreadable arms are bent upwardly towards the antenna base by the spreading element, each of the spreading arms of the spreading element, and each of the spreadable arms of the anchoring claw ride within guides formed by slots in the socket part.

22. An antenna holder according to claim 21, wherein the spreading arms have bent sliding surfaces diverging from the antenna base for acting on the arms of the anchoring claw.

23. The antenna holder according to claim 21, wherein the spreadable arms of the anchoring claw have embossings extending over part of the length of the arms, with a convexly curved outer side facing the antenna base and with a concavely curved inner side pointing away from the antenna base, and wherein the spreading arms of the spreading element are provided on an upper side of the spreading arms, facing the antenna base, with sliding surfaces which are bent and are convex in cross-section, which are essentially configured to correspond generally in shape to the concave inner sides of the spreadable arms of the anchoring claw.

24. An antenna system, comprising:

a roof antenna for a motor vehicle; and an antenna holder to be mounted on a body part of a motor vehicle having an opening, including:

an antenna base; and a preassembled anchoring device projecting beyond the antenna base, the outer cross section of the preassembled anchoring device being smaller than an opening cross section of the opening of the motor vehicle, wherein the preassembled anchoring device includes:

a socket part which is connected with the antenna base, an anchoring claw having a plurality of spreadable arms, a spreading element, and an actuating member with at least one of an axis of rotation and a central axis;

wherein the spreadable arms of the anchoring claw, in a non-deformed initial state, are arranged running from a center part of the anchoring claw obliquely away from the antenna base and outwards from the axis of the actuating member, wherein the spreading element is arranged on a side of the anchoring claw lying facing away from the base plate, wherein the spreading element has spreading arms that act on the spreadable arms of the anchoring claw so that on actuation of the actuating member the spreadable arms of the anchoring claw are spread apart as the spreading element approaches the antenna base, the spreading element bending the spreadable arms of the anchoring claw while effecting a deformation and directing the spreadable arms towards the antenna base so that free ends of the spreadable arms in a spread-apart position press onto a surface of the body part facing away from the antenna base, and wherein as the spreadable arms are bent upwardly towards the antenna base by the spreading element, each of the spreading arms of the spreading element, and each of the spreadable arms of the anchoring claw ride within guides formed by slots in the socket part.

* * * * *

UNITED STATES PATENT AND TRADEMARK OFFICE

CERTIFICATE OF CORRECTION

PATENT NO. : 8,511,634 B2
APPLICATION NO. : 12/224075
DATED : August 20, 2013
INVENTOR(S) : Henry Lerchner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 830 days.

Signed and Sealed this
Fifteenth Day of September, 2015

Michelle K. Lee

Michelle K. Lee
*Director of the United States Patent and Trademark Office*